US005927187A

United States Patent [19]

Bosch

[11] Patent Number: 5,927,187

[45] Date of Patent: Jul. 27, 1999

[54] PROCESS FOR MAKING JUICE AND JUICE PRESS, ESPECIALLY WINE OR FRUIT PRESS

[76] Inventor: Bernhard Bosch, Am Stockert 8, D-79312 Emmendingen, Germany

[21] Appl. No.: 08/875,315

[22] PCT Filed: Jan. 8, 1996

[86] PCT No.: PCT/EP96/00044

§ 371 Date: Aug. 6, 1997

§ 102(e) Date: Aug. 6, 1997

[87] PCT Pub. No.: WO96/22186

PCT Pub. Date: Jul. 25, 1996

[30] Foreign Application Priority Data

Jan. 17, 1995 [DE] Germany ..... 195 01 116

[51] Int. Cl.[6] ..... B30B 9/22

[52] U.S. Cl. ..... 100/37; 100/116; 100/127

[58] Field of Search ..... 100/110, 112, 100/116, 125, 126, 127, 211, 37

[56] References Cited

U.S. PATENT DOCUMENTS

| | | | |
|---|---|---|---|
| 4,387,634 | 6/1983 | Balass | 100/116 |
| 4,872,404 | 10/1989 | Quetsch et al. | 100/110 |
| 5,081,921 | 1/1992 | Gregoire | 100/110 |
| 5,355,785 | 10/1994 | Pera et al. | 100/116 |
| 5,365,838 | 11/1994 | Valentini | 100/211 |

FOREIGN PATENT DOCUMENTS

| | | |
|---|---|---|
| 0 268 546 | 5/1988 | European Pat. Off. . |
| 0 341 098 | 11/1989 | European Pat. Off. . |
| 2 530 424 | 1/1984 | France . |
| 2 615 444 | 11/1988 | France . |
| 2 656 566 | 7/1991 | France . |
| 2 701 664 | 8/1994 | France . |
| 30206 | 2/1885 | Germany . |
| 1 502 181 | 8/1969 | Germany . |
| 1 627 854 | 2/1971 | Germany . |
| 30 39 248 | 5/1982 | Germany . |
| 34 40 558 | 5/1986 | Germany . |
| 295 00 611 | 4/1995 | Germany . |
| 529 412 | 2/1984 | Spain . |
| 1 491 108 | 11/1977 | United Kingdom . |
| 91/06422 | 5/1991 | WIPO . |

*Primary Examiner*—Stephen F. Gerrity
*Attorney, Agent, or Firm*—Panitch Schwarze Jacobs & Nadel, P.C.

[57] ABSTRACT

The invention relates to a process for making juice from grapes, fruit or like material to be pressed, in which the fruit, etc., is repeatedly pressed in unmixed charges at time intervals. The invention also relates to a juice press (1), especially a wine or fruit press, with a drum or similar container (2) having slots, holes or similar flow openings in its longitudinal sides and a feed plate or similar component (4) longitudinally movable inside the container, in which the container (2) has at least one rape or discharge opening in the advancing direction in front of the feed component and there is at least one expandable press hose or similar expanding body inside the container between the feed component (4) and the discharge opening. The characteristic of the juice press of the invention is that the feed plate or the like (4) has slots, holes or like flow openings (3) at least in its region contacting the fruit, etc. Thus the juice run-off area is increased in relation to the quantity of grapes in such a way that the juice press (1) of the invention is characterized by high efficiency and juice quality and a very low sludge content.

30 Claims, 6 Drawing Sheets

FIG. 4
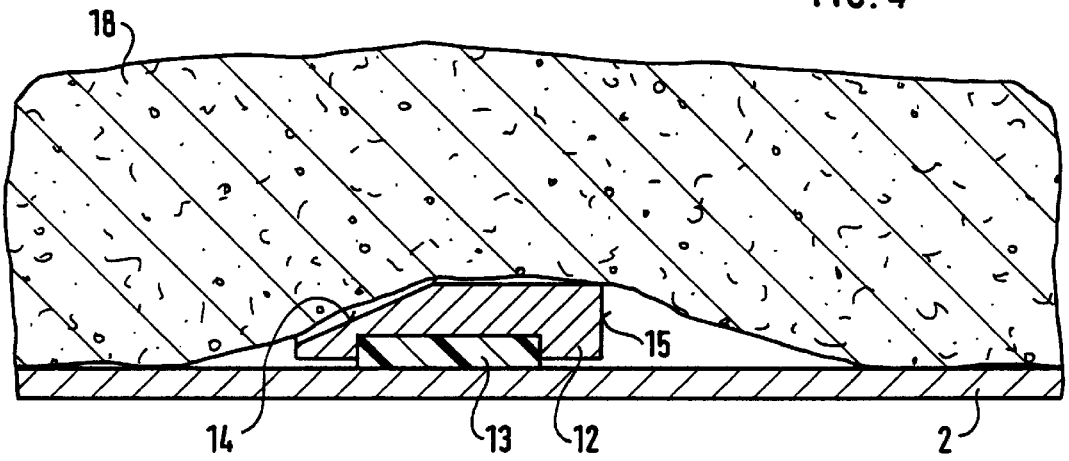
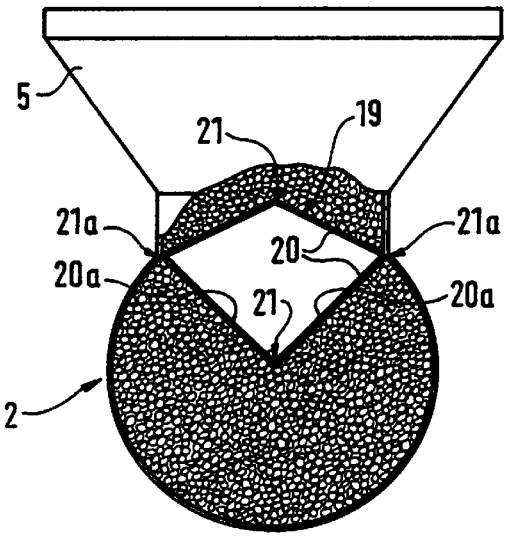
FIG. 5

PROCESS FOR MAKING JUICE AND JUICE PRESS, ESPECIALLY WINE OR FRUIT PRESS

BACKGROUND OF THE INVENTION

The invention relates to a process for making juice from grapes, fruit or like material to be pressed, which is fed forward in batches in a container from a charge opening to a discharge opening approximately by the longitudinal extent of the charge opening, whereby the material is pressed in the container region disposed between the charge opening and discharge opening by means of at least one press hose or like expanding body, whereby the material is repeatedly pressed in unmixed batches at time internals, and whereby the charge region of the container is separated for the feed-in operation of the material, and whereby the material is pre-compressed, preferably in an essentially void-free manner, into the charge region of the container.

The invention also relates to a juice press, especially a wine or fruit press, including a drum or like container having slots, holes or like flow openings in its longitudinal walls, and further including a feed plate or like feed element longitudinally movable inside the container, the container having at least one pomace or discharge opening disposed in front of the feed element in the direction of feed and at least one expandable press hose or like expanding body being provided inside the container between the feed element and the discharge opening.

From EP-A-0 341 098 A a wine press is already known which has a horizontally disposed drum with a perforated case. The material to be pressed is supplied to the drum by way of a central feed pipe terminating inside an end region of the drum. A helical feeding device is provided at the extreme inner periphery of the drum and advances the material batchwise by rotary motion to a discharge opening arranged at the opposite drum end. The drum is subdivided into several sections in the direction of feed, one central press diaphragm being assigned to each. The press diaphragms can be expanded separately from one another in such a way that the material is urged against the inner wall of the drum and juice is thus extracted. Since, as the drum rotates, the feeding device arranged at the inner periphery of the drum contacts the material only in its outer area, it is inavoidable that the cake of material is drawn apart and broken open. Between each pressing interval the material is in any case loosened and crumbled by a change in the direction of rotation of the drum and feeding device it contains, such leading, however, to an undesirably high sediment content in the juice.

From FR-PS 90 00 139, a juice press of the type mentioned at the outset is already known, which has a container which is approximately square in cross-section and is formed from bars. The container, whose longitudinal axis is disposed approximately horizontally, has on the top side of its casing a charge hopper disposed at an end face of the container in the region of a feed plate. The feed plate is longitudinally movable inside the container and is thus able to move the material, which is fed in via the charge hopper, to the opposite open end of the container, which serves as a discharge opening for the fruit or grape pomace.

Between the feed plate and the discharge opening there is provided on the upper inner wall of the container a pressing bellows, which is expandable in the direction of the container bottom. Using this multicellular pressing bellows, the material consisting of mash, fruit or grapes can be pressurized such that the fruit juice flows out via the permeable container bottom and drips into a juice collecting tray beneath.

Since the pressed-out juice flows out essentially only via the container bottom, this previously known press has only a limited pressing output. As a result of the movement of the material solely by means of the feed plate provided inside the container, there is the danger, moreover, that the individual fruit or pomace layers will be pushed together, which may result in an undesirably high sediment content in the juice.

SUMMARY OF THE INVENTION

The object is therefore, in particular, to provide a process for making juice and a juice press of the type mentioned at the outset, which are distinguished by high efficiency and juice quality. This object is accomplished according to the invention in the process of the type mentioned at the outset particularly in that the feed forces are transferred to the strand of material, formed from the batches, at its end face facing the charge opening and at the periphery of the strand.

In the process according to the invention, the material is pressed in unmixed batches. The filter effect of the material is thereby utilized. Since mixing of the batches of material is prevented, the dirt particles and sediment contained in the material are not conducted outwards and carried in the juice. The juice made in the process according to the invention is therefore distinguished by a high juice quality which is particularly low in sediment.

In order to prevent the batches of material adjoining one another in the container from being mixed together, it is advantageous if the charge region of the container is separated for the feed-in operation of the material to be pressed. By separating the charge region from the pressing region of the container, a wide-area cone of dumped material is prevented, which might otherwise foster mixing of the batches of material.

A compact and comparatively stable form can be lent to the material as early as in the charge region, if the material is pre-compressed, preferably in an essentially void-free manner, into the charge region of the container. The material can already be pre-formed in the charge region such that its outer contour remains in the clear cross-section of the container when the expanding body is unexpanded, thereby preventing the expanding body (bodies) from being able to break up the strand of material formed from the batches and so destroy its homogeneity.

In order to be able effectively prevent mixing of the batches also during advancement in the region between the charge opening and the discharge opening, a preferred procedure according to the invention envisages that the feed forces are transferred to the strand of material, formed from the batches, at its end face facing the charge opening and at the periphery of the strand.

In the juice press of the type mentioned at the outset, the solution according to the invention consists particularly in that the feed plate or like feed element has slots, holes or like flow openings, at least in its region contacting the material. Whilst, in previously known juice presses, the pressed-out fruit or grape juice can drip down via the longitudinal walls of the container or even solely via the container bottom, in the juice press according to the invention the feed plate or like feed element is constructed, by means of the flow openings provided there, in such a liquid-permeable manner that this too serves as a drip surface. Since grapes, for example, burst under pressure best in the region of the permeable container walls, moreover, the material in the press according to the invention can be pressed out over a large area, thereby additionally promoting the high efficiency of the press according to the invention.

In contradistinction, it is necessary in previously known pneumatic horizontal presses that the material forced radially against the inner walls of the container be loosened at intervals, in order to bring the unopened grapes still present in the material likewise into the region of the permeable container walls. As a result of such crumbling, the sediment content of the pressed-out juice is, however, increased. In the juice press according to the invention, on the other hand, any such crumbling of the material is unnecessary owing to the large juice drainage area, thereby enabling the sediment content of the juice to be kept very low. Moreover, the large juice drainage area shortens the pressing operation at comparatively low operating pressures, which additionally promote the high juice quality. The juice press according to the invention is suitable both for mash and for whole-grape processing and can equally be used for fruit and for grapes.

A particularly advantageous further development according to the invention, which is worthy of protection in its own right, envisages that at least one slide for the material is provided, which slide is disposed inside the container between the feed element and the discharge opening and is movable in the longitudinal direction of the container. By the use of this slide, the advancement of the pomace to the discharge opening and hence the cyclically continuous working method of the juice press according to the invention are assisted. The pomace can be moved to the discharge opening and transported away into the open in such a way that a mixing-up of the pomace and hence a clouding of the juice are prevented.

It is expedient if the slide(s) for the material extends (extend) at least partially over the container cross-section and if the slide(s) is (are) preferably of essentially annular configuration.

In order also to be able to free the residual skins attaching to the longitudinal walls of the container and automatically clean the flow openings provided there, it is particularly advantageous if the slide(s) is (are) displaceable on the inner wall of the container.

The onward transportation of the material and the cleaning of the juice drainage paths by means of the slides are additionally fostered if a plurality of slides are provided, which are preferably approximately uniformly spaced from one another in the direction of feed.

A preferred embodiment of the invention envisages that that face of the slides which faces the feed element is tapered from inside to outside in the direction of the feed element and that that face of the slides which faces away from the feed element is disposed approximately radially to the longitudinal axis of the container. Whilst the material can be reliably and easily pushed ahead with that radial side of the slides which faces away from the feed element, those faces of the slides which face the feed element and taper obliquely in the direction of feed are moved back counter to the direction of feed into their starting position, whereupon the external slides do not alter the layered sandwich of the material but, during their return travel, move the grapes only in an approximate wave shape. This only slight structural change is sufficient to achieve an improved juice drainage without any need for any great crumbling, which otherwise leads to the known increase in sediment in the must. In the juice press according to the invention, the natural filtration of the pomace cake is thus maintained, thereby additionally promoting the high juice quality.

In order to be able to move on the slides as the material together with the feed element is transported onward, it is advantageous if the slide(s) is (are) connected essentially immovably to the feed element.

A particularly advantageous further development according to the invention envisages that in the region of the charge opening of the container there is provided at least one expandable closing element, which, in its expanded position, closes off the charge opening. When the closing element disposed approximately centrally in the charge opening of the container is expanded and the charge hopper is closed off from the charging bay, the material is pre-compressed by the closing element and is pre-formed such that the press hose disposed on the top side of the container is not damaged during the advancement of the pomace. As the closing element stretches and contracts, its upper portion also thrusts into the charge hopper, where it upwardly moves the mass of grapes or mash held together as a result of the already effected juice drainage, loosens it and thereby fosters rapid charging of the material.

In order to try to stop the batches of material from being broken up during their advancement at the at least one expanding body, it is expedient if the original contour of the press hose or like expanding body is disposed within the extended outer contour of the closing element. In this embodiment, the material is compressed and pre-formed, by the use of the closing element, already in the charge region of the juice press, such that the material fed forward by means of the feed element roughly corresponds to the clear crosssection of the container when the expanding body is unexpanded.

It is expedient if the closing element has a square cross-section and has four wall regions, which are preferably articulately coupled by hinged shafts. The closing element thus virtually has a rhombic cross-section. When the charge opening is opened and the rhombic closing element is stretched, the upper portion of the latter penetrates the charge hopper, thereby dividing the material. This division assists the loosening of the material, especially when a mash is pressed. As the rhombic closing element is stretched and its wedge-shaped lower portion is narrowed, this portion is simultaneously extended forward, where, in the adjoining region of the material, the grapes or the mash aggregate remains looser, so that the press hose is more easily able to penetrate during inflation. At the same time, a uniform distribution of the material over the cross-section of the container is thus achieved, thereby promoting a high pressing output and uniformly short juice drainage paths.

It is particularly advantageous if the closing element is expandable in the transverse direction, preferably approximately at right angles to the longitudinal axis of the container. This arrangement of the closing element promotes the division of the material and its even distribution on the inner walls of the container by means of the closing element.

In order to be able to regulate the expanding motions of the closing element in a controlled manner, it is advantageous if two hinged shafts disposed on opposite sides of the closing element are guided displaceably, preferably on both sides, in approximately horizontally directed sliding guides.

A preferred embodiment according to the invention envisages that the sliding guides on both sides of the closing element are matched or approximate to the contour of the container in an approximate arc shape or curve shape in the direction of their outer end positions of slide. During the closing operation, the lower wedge end of the closing element is thus additionally drawn up into the charge region of the charge hopper and, on the top side, forcibly widens the wedge shape in the grape pile or mash cake. At the same time, the lower wall regions of the closing element are pushed forward into the material, so that, as the closing element is expanded, additional quantities of material are forced into the container. To this end, it is particularly advantageous if the mutually adjoining lower wall regions of the closing element disposed approximately in a V-shape one to another are formed inwardly in a concave or approximately arc-shaped arrangement.

In order to be able to carry away any juice made as the closing element is expanded and the material is pre-formed, it is expedient if at least the lower, plate-shaped wall regions of the closing element have slots, holes, perforations or like flow openings. As a result of the pre-pressing and preliminary extraction of juice from the material, which is particularly important in pressing mash, the efficiency of the juice press according to the invention and rapid juice extraction are fostered.

In order to allow the charge hopper to be used as a preliminary juice extractor, it is expedient if the upper plate-shaped wall regions of the closing element have corresponding slots, holes, perforations or like flow openings. A grape picker or grinder can be upstream of the charge hopper. The juice therefore already obtained in the charge hopper is thereby able to run off via the upper walls of the closing element. An embodiment in which both the upper and the lower wall regions of the closing element have such flow openings is preferred.

In order also to be able to make large quantities of juice of high juice quality from mash and to be able in this case to dispense with a separate drip tank or mash tank, as hitherto continues to be used in the prior art, it is advantageous if in the charge hopper there is provided a drip insert, the side walls of which have flow openings and are preferably provided at a short distance from the inner walls of the charge hopper.

In order to remove this drip insert from the charge hopper and in order to be able to process e.g. whole grapes instead, using the juice press according to the invention, it is expedient if the drip insert can be detachably inserted into the charge hopper.

Since a preliminary juice extraction can be achieved using the closing element of the juice press according to the invention, it is advantageous if the container peripherally has flow openings, including in the pressing region of the expandable closing element, through which flow openings the juice pressed out by means of the closing element can run out of the container and flow into a juice trap.

It is beneficial for the pressing process of the juice press according to the invention taking place in timed sequence or cyclically-continuously if that face of the container which is disposed in front of the feed element in the direction of feed is configured as a discharge opening.

In order to be able to undertake preliminary juice extraction even as the feed element is advancing, it is advantageous if the discharge opening can be opened and closed by means of a counter-plate or like abutment and if this abutment is movable preferably in an approximately radial direction in front of the discharge opening. During the return travel of the feed element, the abutment is also raised, so that, upon the subsequent feed motion of the feed element, the pomace which is disposed in front of it in the direction of feed is conveyed into the open by a length corresponding to the feed motion. If the feed element is in its forward feed position in the direction of feed, the discharge opening is closed by means of the abutment in order to be able, following a preliminary juice extraction where appropriate, to commence the pressing operation by expansion of the press hoses provided inside the container.

The pomace cake, which is fed forward into the open through the discharge opening, can be easily separated off and the discharge opening can be effectively closed if that region of the abutment which faces the discharge opening is configured as a cutting edge.

It is particularly advantageous if a plurality of expanding bodies are provided which can be expanded separately from one another and preferably at different operating pressures. It is thereby possible, for example, firstly to expand two inner, mutually adjacent expanding bodies at an approximately 0.5 bar higher operating pressure, so as then to expand the outer, neighbouring expanding bodies more strongly. As a result of this expansion of the individual expanding bodies, which is enhanced in a crisscross pattern, the material is stretched in the region of the adjacent expanding bodies subjected to different operating pressures, whereby the juice drainage ducts are advantageously opened.

For the repair and maintenance of the expanding bodies, it is advantageous if the expanding body (bodies) is (are) provided on a possibly multi-door container cover, which is disposed on the periphery of the container and is directed preferably in the longitudinal direction of the container.

An embodiment is preferred in which the juice press according to the invention is disposed as a horizontal press and the longitudinal axis of the container is disposed approximately horizontally.

For the collection of the juice dripping from the container, there is disposed beneath the container a juice trap, which preferably also extends over the feed region of the feed element. If the juice trap also extends over the feed region of the feed element, the juice pressed out with the aid of the closing element in a preliminary juice extraction stage can also be separated, collected and utilized.

It is expedient if at least one juice collecting tray is configured as a juice trap.

A plurality of juice collecting trays can be provided, which are respectively assigned to a portion of the container. In contradistinction, another embodiment according to the invention envisages for the fractionation of the must that the juice collecting tray is divided by at least one partition into a plurality of tray regions, which are preferably separated from one another in an essentially liquid-tight manner, and that at least one lead-in region is provided, which is guided displaceably or is held in a similarly adjustable manner beneath the container and above the juice collecting tray.

In order to be able to bring about a fractionation of the must in accordance with the produced juice quality, it is advantageous if the charge region of the container is allocated a separate tray region or a separate juice collecting tray.

BRIEF DESCRIPTION OF THE DRAWINGS

Further features of the invention follow from the description below of an exemplary embodiment of the invention, taken in conjunction with the claims and the drawings. The individual features can be realized individually or in combination in an embodiment according to the invention. In the drawings, FIG. 4 is a partly sectional view of the container of the juice press of FIGS. 1 to 3 in the region of one of its slides movable on the inner wall of the container, and FIG. 5 is a cross-sectional view of a container which, in the region of its charge opening, has an expandable closing element closing the charge opening in its expanded position represented in FIG. 5.

DETAILED DESCRIPTION OF THE INVENTION

Figure 1:
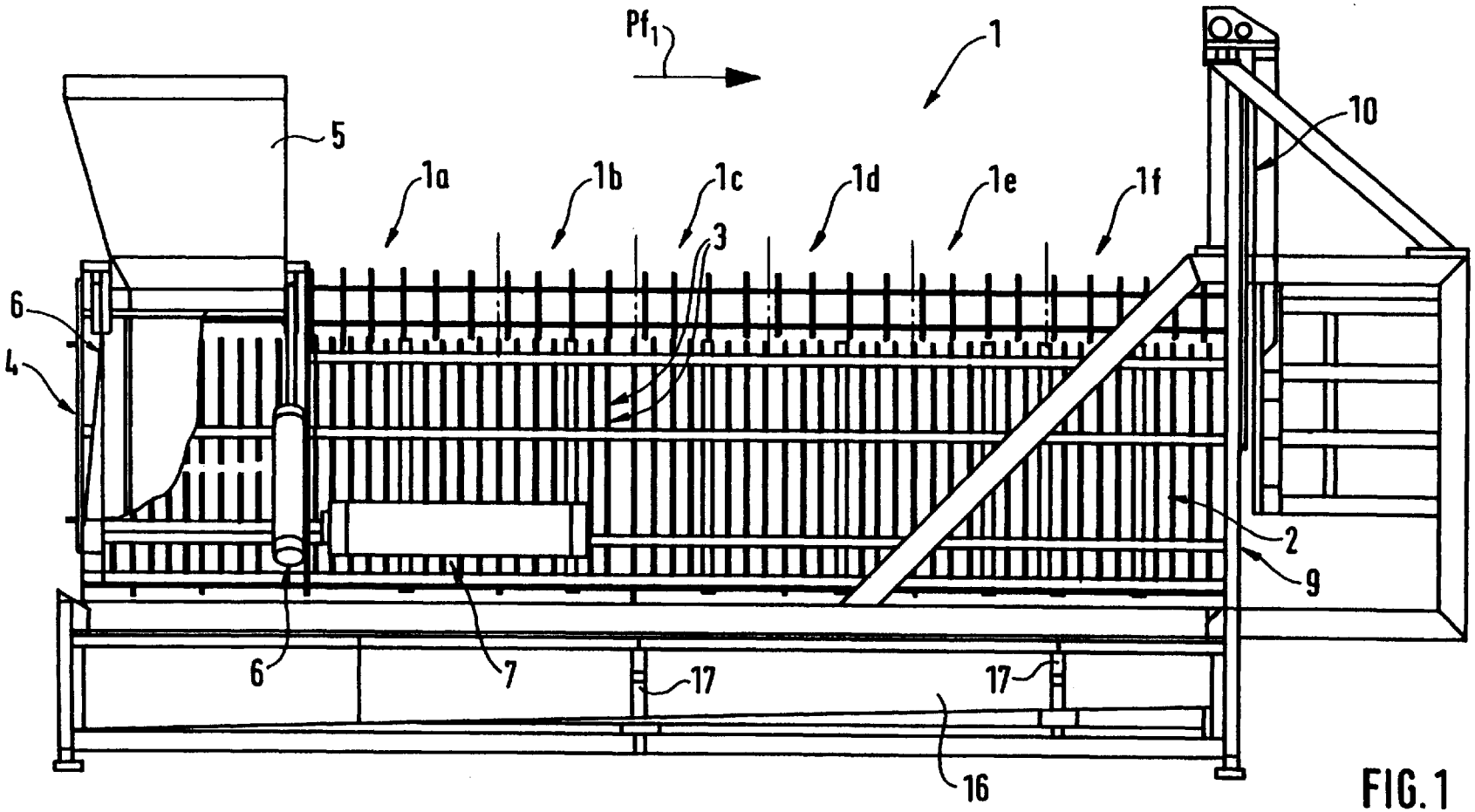
FIG. 1 is a side view of a pneumatic horizontal juice press whose container has in the region of a charge hopper a frontal feed plate or like feed element, which is movable in the longitudinal direction of the container and is designed so as to be liquid-permeable by means of slots or like flow openings.
Figure 2:
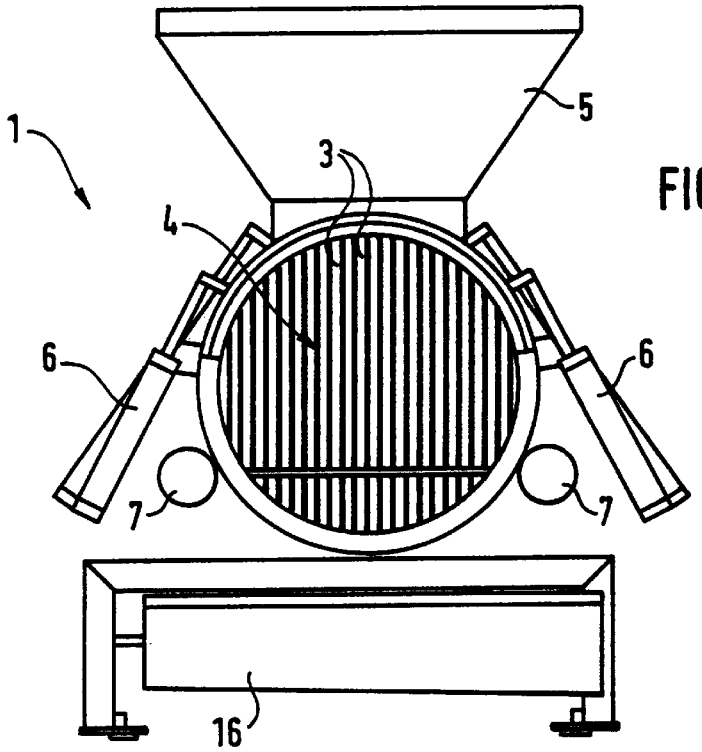
FIG. 2 is the juice press of FIG. 1 in a front view directed onto the feed element.
Figure 3:
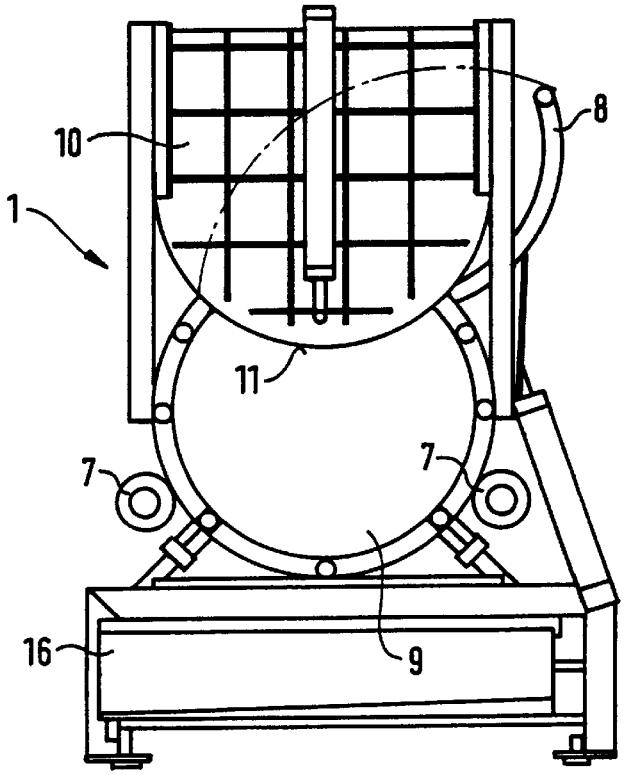
FIG. 3 is a rear view of the juice press of FIGS. 1 and 2, the end discharge opening of this juice press being openable and closable by means of a counter-plate or like abutment.

FIGS. 1 to 3 depict a juice press 1 which is configured as a pneumatic horizontal hose press and serves as a fruit or wine press. The juice press 1 has a drum 2 having slots or like flow openings 3 in its longitudinal walls. The drum 2 is approximately tubular and round in cross section. At the end face to the left of the drum 2 in FIG. 1 is a feed plate 4 which serves as a feed element and is movable longitudinally inside the drum 2. In the region of the feed plate 4, the drum 2 is peripherally provided with a charge hopper 5, via which the fruit or grape mash and, in particular, whole grapes also can be charged into the juice press 1 in order to be pressed. The drum opening limited by the charge hopper 5 can be opened and closed by two sliding flaps, which are of circular-segment shape and are matched to the drum periphery and are in each case movable by means of two pneumatic cylinders 6.

The feed plate 4 sweeps in the direction of feed approximately over the charge opening, limited by the charge hopper 5, of the drum 2, so that the feed path of the feed plate measures, for example, approximately ⅕ of the longitudinal extent of the container. The feed plate 4 can be driven in the direction of feed Pf1 by means of two pneumatic cylinders 7 disposed on the drum periphery approximately parallel to the longitudinal axis of the drum. Instead of a pneumatic drive, an electromechanical or hydraulic drive can also be provided for the feed plate 4. The feed plate 4 movable inside the container approximately fills the cross-section of the drum.

Similarly to the longitudinal walls of the drum 2, the feed plate 4 also has a bar-shaped or slotted structure having a multiplicity of parallel slots 3 forming the flow openings for the pressed-out juice. To this end, the feed plate 4 comprises a multiplicity of bars which are interconnected in spaced relationship and keep the intermediate flow openings 3 clear.

By virtue of the slotted feed plate 4, the juice press 1 is distinguished by a good relationship between the juice drainage area and the grape quantity. The juice drainage paths are thereby kept short and excessive oxidation of the juice is prevented. Since the grapes burst under pressure best in the region of the permeable container walls, the material can be pressed out in the juice press 1 over a large area, thereby additionally promoting the efficiency and juice quality of this juice press 1.

Figure 10:
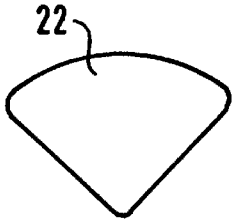
FIG. 10 is a front view of an expanding element in the unexpanded state.

As the feed plate 4 advances, a preliminary juice extraction might possibly be achieved. For the main pressing operation, a plurality of expanding bodies are provided inside the container, of which one expanding body 22 is represented in FIG. 10 in a front view in the unexpanded state. The expanding bodies can be joined together to form a segmented press hose or a press diaphragm. Preference, however, is given to an embodiment in which these expanding bodies are separately formed, can be activated separately from one another and are preferably expandable at different operating pressures. These expanding bodies are provided on a single-door container cover 8, which can be opened for the maintenance and repair of the expanding bodies, but is not provided for grape-charging or hopper-emptying purposes.

In order to empty the drum 2, that face of the container which is disposed in front of the feed plate 4 in the direction of feed Pf1 and serves as a discharge opening 9 can be opened and closed by means of a counter-plate 10 movable radially to the drum 2 in front of its opening 9. For the pressed-out pomace cake fed forward by the feed plate to be removed easily after each pressing operation, that region of the counter-plate 10 which faces the discharge opening 9 is configured as a cutting edge 11.

The separately expandable bodies of the segmented press hose divide the inside of the container into a plurality of pressing regions 1*a*, 1*b*, etc. disposed one behind the other in the direction of feed Pf1. Each pressing region 1*a*, 1*b*, etc. is allocated a slide 12 for the material to be pressed, which slide is disposed inside the container between the feed plate 4 and the discharge opening 9 and is displaceable in the longitudinal direction of the container. These slides 12 are of approximately annular configuration and are guided displaceably on both sides of the cover opening of the container cover 8 so as to bear against the inner wall of the container by means of (plastic) sliding bodies 13. These slides 12 are connected essentially immovably to the feed plate 4 by at least one common longitudinal bar and thus are jointly moved in the direction of feed Pf1 as the feed plate 4 advances. It is also possible to drive the slides 12 along the direction of feed Pf1 independently of the feed plate 4. The slides 12 thus assist the transport motions of the material inside the container and the carrying away of the pomace 18, so that the layer structure of the latter remains unaltered.

Since the natural filtration of the pomace cake is maintained and, in the case of the juice press 1, because of the large juice drainage area as a consequence of the slotted feed plate 4, repeated crumbling can be dispensed with, the pressing result of the juice press 1 is distinguished by a high juice quality with a particularly low sediment content.

As becomes clear from the longitudinal section in FIG. 4, that face 14 of the annular slide 12 which faces the feed plate is tapered from inside to outside in the direction of the feed plate 4. Upon the return motion of the feed plate 4 counter to the direction of feed Pf1, the slides 12 connected thereto are also therefore moved in the outer region of the material. This return motion of the slides 12 produces a wave-shaped motion of the pomace cake 18 and thereby, at the same time, also a continuous opening of the juice drainage ducts. Since the slides 12 move via the sliding bodies 13 directly along the container inner wall of the drum 2, adhering residual pomace is freed and also the slots 3 in the peripheral casing of the drum 2 are automatically mechanically cleaned.

It can be seen in FIG. 4 that, in contradistinction, that face 15 of the slides 12 which faces away from the feed plate 4 is disposed approximately radially to the longitudinal axis of the container, thereby additionally assisting the onward transportation of the material.

The grapes or similar material to be pressed, which are charged via the charge hopper 5 into the interior of the drum 2, are moved into the foremost pressing region la by the feed plate 4 serving as a feed element. The pomace cake located in the following pressing regions 1*b*, 1*c*, etc. of the drum 2 is thereupon transported onward, the part of the pomace originally contained in the pressing region remote from the feed plate 4 making its way into the open through the discharge opening 9. Once the feed plate 4 has reached its end position of slide facing the discharge opening 9, the discharge opening 9, which is open during the return travel of the feed plate 4, is closed by means of the counter-plate 10 serving as an abutment. After a preliminary extraction of juice from the material during the advancement of the feed plate 4, the material is pressed for about 8 to 10 minutes pneumatically from above by means of the segmented press hose, this taking place in each of the pressing regions according to requirement, depending upon the grape variety, tie state of maturity, the degree of putrefaction and the yield requirement. The operating pressures in the individual expanding bodies are continually increased 5 times from 0.5 to 1.5 bar, maximally to 3 bar. Using a control device (not represented here), the individual expanding bodies of the press hose can be separately activated such that first two adjacent expanding bodies disposed approximately centrally to the longitudinal extent of the drum are pumped up at an operating pressure which is 0.5 bar higher relative to the two adjacent outer pressing regions, so as then, in turn, to expand the outer expanding bodies adjacent thereto 0.5 more strongly than the adjacent pressing regions which they enclose. As a result of this practically crosswise non-uniform pressurization of the expanding bodies assigned to the individual pressing regions, the material present inside the container is regionally slightly stretched, advantageously opening the juice drainage ducts in the material.

The grapes or similar material to be pressed are advanced in timed sequence in the juice press 1 from each individual pressing region in the direction of the discharge opening 9, so as to be newly pressed in each of the individual pressing regions. The structure of the grape cake or pomace cake is not significantly altered by the transport motion of the material brought about by the feed plate 4. The juice pressed out of the material can drip into a juice collecting tray 16, which is disposed beneath the drum 2 and extends over its entire longitudinal extent including the feed region of the feed plate 4. This juice collecting tray 16 is divided by two partitions 17 into a plurality of tray regions separated from one another in a liquid-tight manner, thereby enabling simple fractionation of the must. Beneath the container and above the juice collecting tray 16 there are provided a plurality of lead-in panels or lead-in walls (not shown), which are guided displaceably in the longitudinal direction of the drum or are held similarly movable. These lead-in panels can be positioned such that the juice dripping from a specific portion of the container flows into the chosen region of the juice collecting tray 16.

The juice press 1 can be recharged, even as pressing takes place, via the charge hopper 5 and is conveniently emptied at its discharge end 9. The juice press 1 thus allows a cyclically continuous operating sequence and is distinguished by its very low sediment content, high pressing output and juice quality.

FIG. 5 depicts a drum 2 having an expandable closing element 19 in the region of its charge opening. The closing element 19 which, in its expanded setting according to FIG. 5, closes off the charge opening of the drum 2, has a square cross-section with four walls 20, the wall regions 20 being articulately coupled by hinged shafts 21. The closing element 19 is expandable approximately at right angles to the longitudinal axis of the drum. To this end, two hinged shafts 21*a* disposed on opposite sides of the closing element are guided displaceably on both faces of the closing element 19 in approximately horizontally directed sliding guides.

Figure 6:
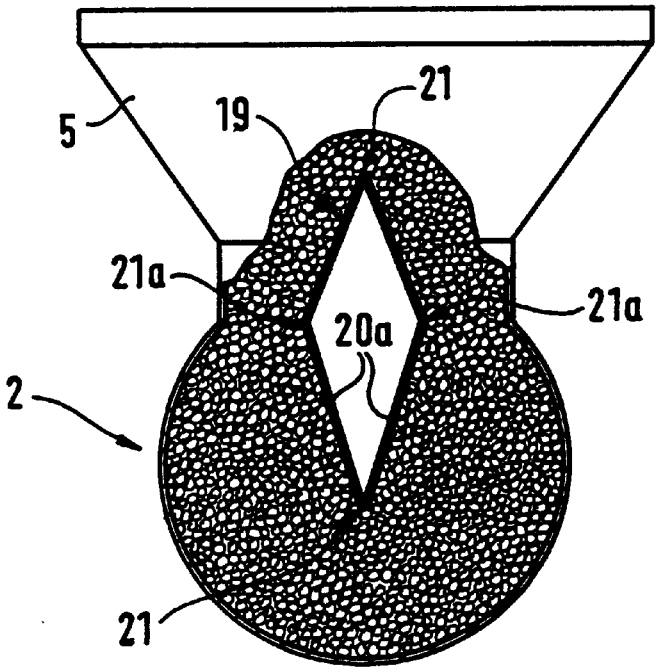
FIG. 6 is the container of FIG. 5, the closing element provided in the region of the charge opening of the container being in its stretched open position.

Whilst the closing element 19, in its expanded position represented in FIG. 5, fills the cross-section of the charge opening and closes this off against the upstream charging bay, stretching of the closing element 19—as shown in FIG. 6—allows the charge opening of the drum 2 to be opened. Upon the expansion of the closing element 19 disposed approximately centrally in the charge opening of the drum 2 and upon closure of the charge hopper against the charging bay, the material is pre-compressed and pre-formed such that, on the one hand, the press hose disposed on the top side of the container is not damaged as the pomace is fed forward and nor, on the other hand, does the batch of material fed forward with the aid of the feed plate into the pressing region of the expanding bodies also become stuck and break up at the first expanding body in the direction of feed, as might otherwise impair the filter effect of the homogenous strand of material in the drum 2.

As a result of the stretching motion of the closing element 19 as the charge opening is opened, the upper portion of the closing element 19 thrusts forward in an approximate wedge shape also into the charge hopper 5, where it moves the grape quantity or mash aggregate upward, loosens it and thereby fosters rapid charging of the material. At the same time, the material is divided, additionally loosening it. During the stretching motion and as the charge opening is opened, the lower portion of the rhombic closing element 19 is also extended downward over the midpoint of the drum, whereby, in the adjoining region of the material, the grapes or mash remain looser and the press hose can more easily penetrate during inflation. As a result of the expanding and subsequent stretching motion of the closing element 19, a uniform distribution of the material over the cross-section of the container is achieved, promoting a high pressing output and uniformly short juice drainage paths.

Figure 7:
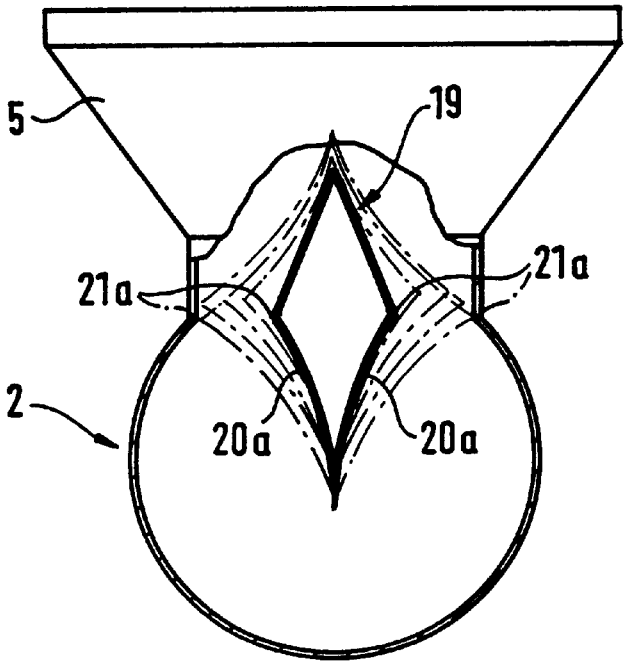
FIG. 7 is a container having in the region of its charge opening a closing element configured similarly to that of FIGS. 5 and 6, and FIGS. 8 and 9 are schematic representations of a horizontal juice press in the region of its closing element, in FIG. 8 in a front view and in FIG. 9 in a side view.

The closing element 19 of the drum represented in FIG. 7, which closing element likewise limits and simultaneously meters out the charge quantity for the drum, is guided in sliding guides by its two hinged shafts 21*a* disposed on opposite sides of the closing element. On both longitudinal sides of the closing element, the sliding guides are matched or approximate to the contour of the container in an approximate arc shape or curve shape in the direction of their outer end positions of slide. As a result of these curve-shaped sliding guides, the closing element 19, during its stretching motion, is additionally moved in the direction of the charge hopper 5. This additional feed motion of the closing element 19 in the direction of the charge hopper 5 is beneficial for loosening the material present in the charge hopper 5. Since, according to FIG. 7, the lower wall regions 20*a* of the closing element 19, which are disposed approximately in a V-shape to one another, are bent inward in a concave or approximately arc-shaped arrangement, as the closing element 19 expands additional quantities of material present in the region of the charge opening are seized and forced into the drum 2.

It is particularly advantageous if the closing element 19 according to FIGS. 5 to 7 has slots, holes, perforations or like flow openings at least in its lower, plate-shaped wall regions 20*a*, preferably in all walls 20. Therefore even as the press cake is being pre-formed, juice can already be extracted from it by means of the closing element 19, the juice flowing away at the two end faces of the closing element 19.

The drum 2 peripherally has flow openings, not only in the pressing region of the expanding bodies 22, 22' but also in the pressing region of the likewise expandable closing element 19, through which flow openings the juice pressed out by means of the closing element 19 in a preliminary juice extraction stage is able to make its way outward and flow away to the juice trap.

Figure 9:
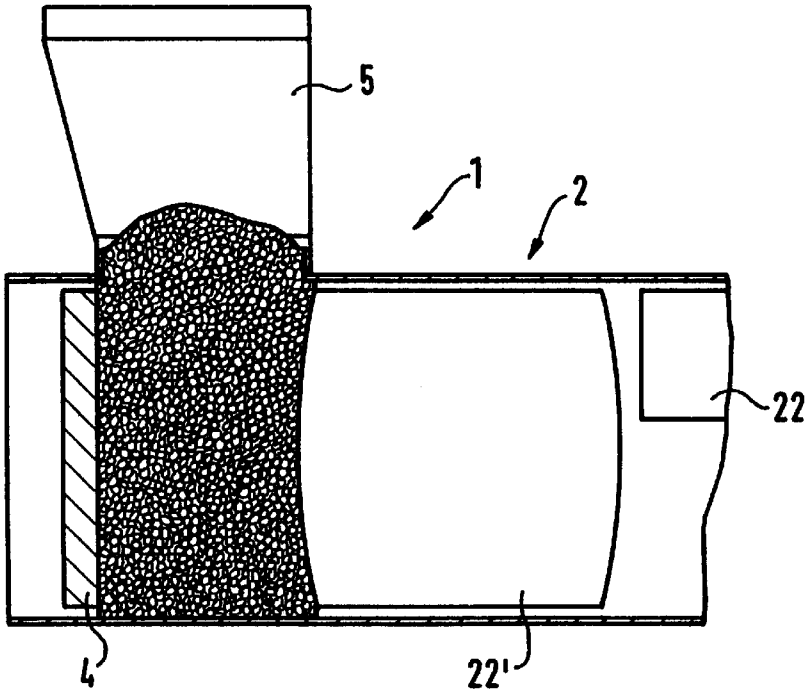
Figure 8:
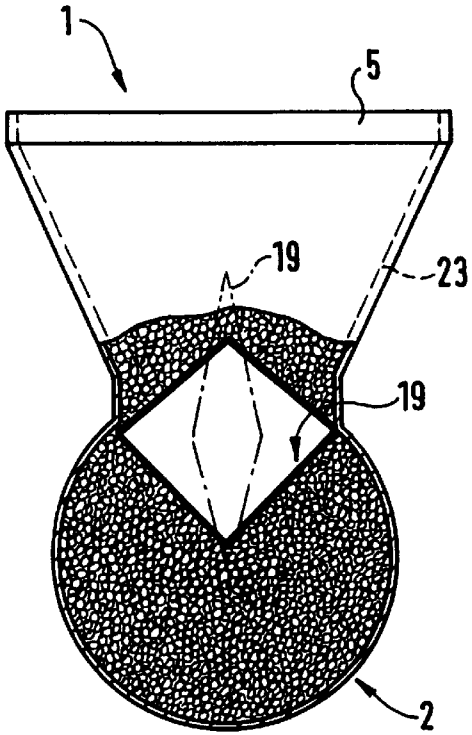

From the diagrammatic representations in FIGS. 8 and 9, it becomes clear that the material replenished via the charge hopper 5 can be compressed and pre-formed using the closing element 19 in such as way as to be imparted a circular or circular segment shape in cross section, here up to three-quarters closed. This pre-forming of the individual batches of material prior to their advancement by means of the feed plate 4 is additionally fostered by the fact that—as indicated in FIG. 9—the charge region is separated from the pressing region of the expanding bodies 22, 22'. To this end, the expanding body 22' facing the charge region is tensioned and expanded in such a way that the material is unable to form a cone, fall into the adjoining drum region and mix with the preceding batches of material.

The closing element 19 allows the material to be compressed and pre-formed in such a way as to fill the charge region of the drum 2 in an essentially void-free manner.

As becomes clear from a comparison of FIGS. 8 and 10, at least that expanding body 22 which faces the charge region has, in the unexpanded state, a cross-section which roughly corresponds to the void produced in the material by the closing element 19. The advancement of the charged material is thereby facilitated and, at the same time, the material is then prevented during advancement from being able to butt against the unexpanded expanding body 22' and to break up there and mix. As a result of the pre-forming of the individual batches of material replenished via the charge hopper 5, the material then fed forward into the pressing region of the expanding bodies 22' is prevented from being stirred-up and collapsing. As a result of the equal distance of the material from the drum periphery with its flow openings, the juice drainage is evened out, thereby speeding up the pressing operation.

Figure 11:
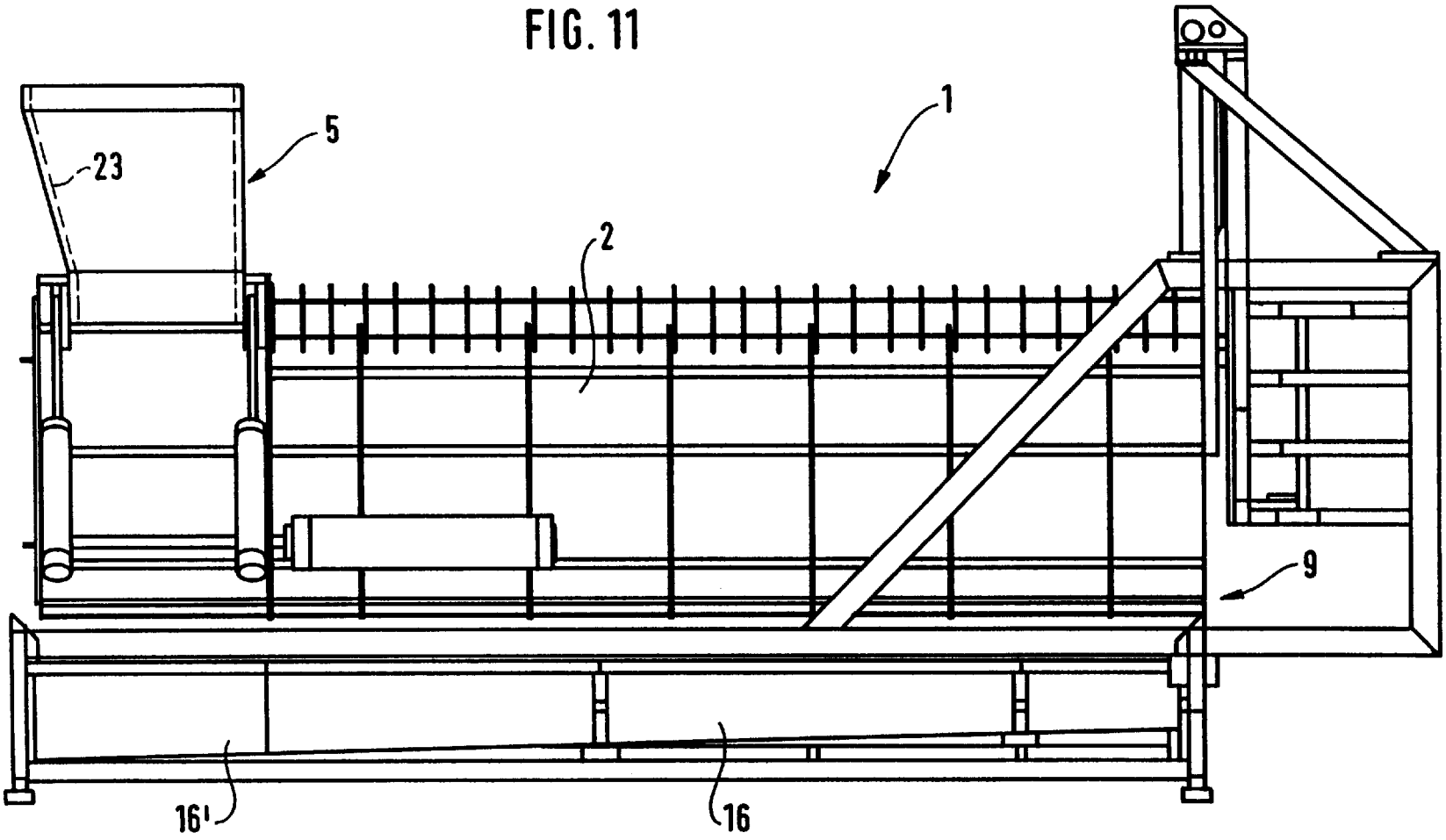
FIG. 11 is a horizontal juice press, similar to that of FIG. 1, in whose charge hopper a drip insert can be detachably inserted.

As indicated in FIG. 11, it may be advantageous to the mash-pressing if in the charge hopper a drip insert 23 is provided, the side walls of which have flow openings and are preferably disposed at a short distance from the inner walls of the charge hopper 5. The material, consisting particularly of mash, can thus be charged into the charge hopper 5 when the closing element 19 is closed, the mash being able to drip away in the drip insert 23. A separate drip or mash tank, such as continues to be used in the prior art, is thus no longer necessary.

To enable pressing juice instead of out of mash, also out of e.g. grapes, it is advantageous if the drip insert 23 is held only detachably in the charge hopper 5 and is removable therefrom for pressing grapes.

In order to obtain high pressing output, including in grape-juice or wine production, and in order to enhance the juice quality still further, it is advantageous if a grape picker (not shown) is disposed above the charge hopper 5. The grapes, which are separated from their stalks by the grape picker, are thus able to fall directly into the charge hopper 5 without the need for a pump, mash tank or agitator.

After the closing element 19 has been opened and the material has started to drip, the latter falls into the charge region of the juice press 1, this being disposed beneath the charge hopper 5. In order to enable the grapes or mash to drip in the charge hopper 5, the drum 2 has also in the charge and pressing region of the closing element 19, on the drum periphery, corresponding flow openings for the passage of the juice. As becomes clear from FIG. 11, beneath the charge region of the drum 2 there is additionally provided, as a preliminary vessel, a separate juice tray 16', which is able to collect and separate the juice which, because of the grape-picking operation, could be rich in sediment.

As the material is being charged into the charge region, that expanding body 22 which faces the charge region and is configured as a pressing bellows is tensioned in such a way that the material is unable to form a cone and mix with the preceding batches of material in the drum 2.

Once the closing element 19 preferably matched in shape to the relaxed form of the expanding body 22, 22', has compressed the material and pre-formed it into the circular-segment shape represented in FIG. 8, the expanding body 22' facing the charge region is also relaxed to enable the feed plate 4 to move the replenished material into the pressing region of the expanding bodies 22, 22'.

When the material has already been sufficiently pressed in the first press fraction by means of the re-pressurized pressing bellows 22, the feed plate 4 is returned into the starting position and the expanding body 22 facing the charge region is once again put under pressure so as to be able to repeat the charging, feed and pressing operations. Short cycle times in, for example, a 10 minute cycle are in this case possible. In the pressing region of the preferably three expanding bodies 22, 22', the juice collecting tray 16 has, according to FIG. 11, three press fractions, each of these press fractions possibly also being allocated a separate collecting tray.

Whilst the juice which has been pressed in the charge region by means of the closing element 19 and collected in the juice collecting tray 16' might still have a comparatively high sediment content, even in the case of mash, the dregs in the pressing region of the expanding bodies 22 can be kept below 2 percent, thereby enabling the juice to be introduced into the fermenting tank, for wine production purposes, without preclarification and, where appropriate, also without separation.

I claim:

1. A process from making juice from grapes or fruit to be pressed, comprising:

feeding the grapes or fruit to be pressed forward in batches in a container from a charge opening to a discharge opening, approximately by a longitudinal extent of the charge opening;

pressing the grapes or fruit in the container in a region disposed between the charge opening and the discharge opening using at least one press hose or expanded body (35);

repeatedly pressing unmixed batches at time intervals;

pre-compressing the grapes or fruit to be pressed in an essentially void-free manner into a charge region of the container, the charge region of the container being separated from the feeding operation of the grapes or fruit to be pressed; and transferring feed forces to a strand of material formed by the batches at an end face facing the charge opening and at a periphery of the strand.

2. A juice press for pressing grapes or fruit comprising:

a container (2) having longitudinal walls, at least one of slots, holes and flow openings located in the longitudinal walls;

a feed element (4) moveable in a longitudinal, feed direction within the container (2), the feed element including at least one of slots, holes and flow openings defined therein in a region adapted to contact the grapes or fruit;

a discharge opening (9) located in the container in front of the feed element in the feed direction; and at least one expandable press hose or expanding body located within the container between the feed element and the discharge opening.

3. A juice press as claimed in claim 2, further comprising:

at least one slide (12) within the container (2) located between the feed element (4) and the discharge opening (9), the slide being movable in the longitudinal direction of the container.

4. A juice press as claimed in claim 3, wherein the at least one slide (12) extends at least partially over a cross-section of the container (2) in an annular configuration.

5. A juice press as claimed in claim 3, wherein the at least one slide (2) is displaceable on the walls of the container (2).

6. A juice press as claimed in claim 3, wherein the at least one slide (12) comprises a plurality of slides which are approximately uniformly spaced from one another in the feed direction.

7. A juice press as claimed in claim 3, wherein the at least one slide has a first face (14) and a second face, the first face being oriented toward the feed element and being tapered from inside to outside in a direction of the feed element, the second face (15) being oriented away from the feed element and being disposed approximately radially to a longitudinal axis of the container.

8. A juice press as claimed in claim 3, wherein the at least one slide is connected immovably to the feed element.

9. A juice press as claimed in claim 2, further comprising:

at least one expandable closing element (19) located within the container, which in an expanded position, closes off the discharge opening (9).

10. A juice press as claimed in claim 9, wherein an outer contour of the at least one expandable press hose or expanding body is confined to an area within an expanded outer contour area of the at least one closing element (19).

11. A juice press as claimed in claim 9, wherein the at least one closing element comprises a closing element (19) which has a square cross-section and four wall regions (20) which are articulately coupled by hinged shafts (21*a*).

12. A juice press as claimed in claim 11, wherein there are two hinged shafts (21*a*) disposed on opposite sides of the closing element, and the two hinged shafts are guided in a horizontal direction by approximately horizontally directed sliding guides.

13. A juice press as claimed in claim 12, wherein the sliding guides on opposite sides of the closing element approximate a contour of the container in an approximate curve shape in a direction of outer end positions of the slide.

14. A juice press as claimed in claim 11, wherein two of the four wall regions are mutually adjoining lower wall regions (20*a*) of the closing element which are disposed approximately in a V-shape to one another and are formed inwardly in one of a concave or an approximately arc-shaped arrangement.

15. A juice press as claimed in claim 14, wherein the lower wall regions of the closing element have at least one of slots, holes, perforations and flow openings.

16. A juice press as claimed in claim 9, wherein the at least one closing element (19) is expandable in a traverse direction which is approximately at right angles to a longitudinal axis of the container.

17. A juice press as claimed in claim 2, further comprising:

a charge hopper (5) connected to the container, the charge hopper having inner walls; and a drip insert (23) located in the charge hopper, the drip insert having side walls which include flow openings located a short distance from the inner walls of the charge hopper.

18. A juice press as claimed in claim 17, wherein the drip insert (23) is detachably insertable into the charge hopper (5).

19. A juice press as claimed in claim 2, further comprising:

at least one expandable closing element having a pressing region located within a charge region of the container, and the container further includes flow openings in the pressing region of the at least one expandable closing element.

20. A juice press as claimed in claim 19, wherein:

the charge region of the container is allocated a separate tray region or a separate juice collecting tray (16).

21. A juice press as claimed in claim 2, wherein the container has a face disposed in front of the feed element in the direction of feed, the face being configured as the discharge opening.

22. A juice press as claimed in claim 2, wherein the discharge opening is openable and closeable via a counter-plate (10) located proximate to the discharge opening, and the counterplate is movable in an approximately radial direction in front of the discharge opening.

23. A juice press as claimed in claim 22, wherein a region of the counter-plate facing the discharge opening (9) is configured as a cutting edge.

24. A juice press as claimed in claim 2, wherein the at least one expandable press hose or expanding body comprises a plurality of expanding bodies which are separately expandable and are adapted to be operated at different operating pressures.

25. A juice press as claimed in claim 2, wherein the container includes a multi-door container cover (9) disposed on a periphery of the container, the at least one expandable press hose or expanding body being provided on the multi-door container cover.

26. A juice press as claimed in claim 2, wherein the container includes a longitudinal axis which is disposed approximately horizontally.

27. A juice press as claimed in claim 2, further comprising:

a juice trap disposed underneath the container, the trap extends over a feed region of the feed element (4).

28. A juice press as claimed in claim 27, wherein the juice trap comprises at least one juice collecting tray (16, 16').

29. A juice press as claimed in claim 28, wherein the at least one juice collecting tray comprises a plurality of juice collecting trays which are assigned to different portions of the container.

30. A juice press as claimed in claim 29, wherein the plurality of juice collecting trays include a plurality of partitions, the plurality of partitions divide the plurality of collecting trays into a plurality of tray regions, the tray regions are held together in an essentially liquid tight manner, the juice press further includes a lead-in plate held in an adjustable manner beneath said container but above said collecting tray.

* * * * *